United States Patent [19]

Jung et al.

[11] Patent Number: 5,018,713

[45] Date of Patent: May 28, 1991

[54] CLOTH-SPREADING APPARATUS HAVING IMPROVED CONTROL MEANS

[75] Inventors: Rolf Jung, Waiblingen, Fed. Rep. of Germany; Andrew A. Nalecz, Williamsville, N.Y.

[73] Assignee: Eastman Machine Company, Buffalo, N.Y.

[21] Appl. No.: 407,820

[22] Filed: Sep. 15, 1989

[51] Int. Cl.[5] ..... B65H 29/46

[52] U.S. Cl. ..... 270/31

[58] Field of Search ..... 270/30, 31; 192/138, 192/143

[56] References Cited

U.S. PATENT DOCUMENTS

| | | | |
|---|---|---|---|
| 4,082,258 | 4/1978 | Smith | 270/31 |
| 4,381,859 | 5/1983 | Jung | 270/31 |
| 4,475,729 | 10/1984 | Costigan | 270/31 |

OTHER PUBLICATIONS

Krauss u. Reichard GmbH + Co. KG Spezialmaschinenfabrik: Kuris Pionier-Super der Stofflegeautomat der Mittelklasse, Microprozessorgesteuert.

Walter: Vollautomatische Stofflegemaschinen Fur: Abschneidelegen, Zick-Zack-Legen, Schlauchware oder kombiniert.

Takaoka: World M-5 Synchron: Wolf-Omni Systems, North America, Inc.

Panther with Demand Feed: Spreading Machine Exchange, Inc.

*Primary Examiner*—John T. Kwon

*Assistant Examiner*—Therese M. Newholm

*Attorney, Agent, or Firm*—Hodgson, Russ, Andrews, Wood & Goodyear

[57] ABSTRACT

A cloth-spreading apparatus having an improved control for controlling the movement of a carriage assembly across an elongated table. The control includes one or more sensors in the form of photoelectric eyes (52-58) which are capable of sensing a light-reflective medium (60, 76) and nonreflective surfaces (72, 74 or 78), which sensed positions are processed by a controller (50) to cause an electric motor (42) to be slowed down when the carriage assembly (24) reaches a slowdown position and to be stopped or reversed when a stop position is attained. The sensors are in an "on" state when the carriage assembly is moving and in an "off" state when the carriage assembly is not moving.

6 Claims, 1 Drawing Sheet

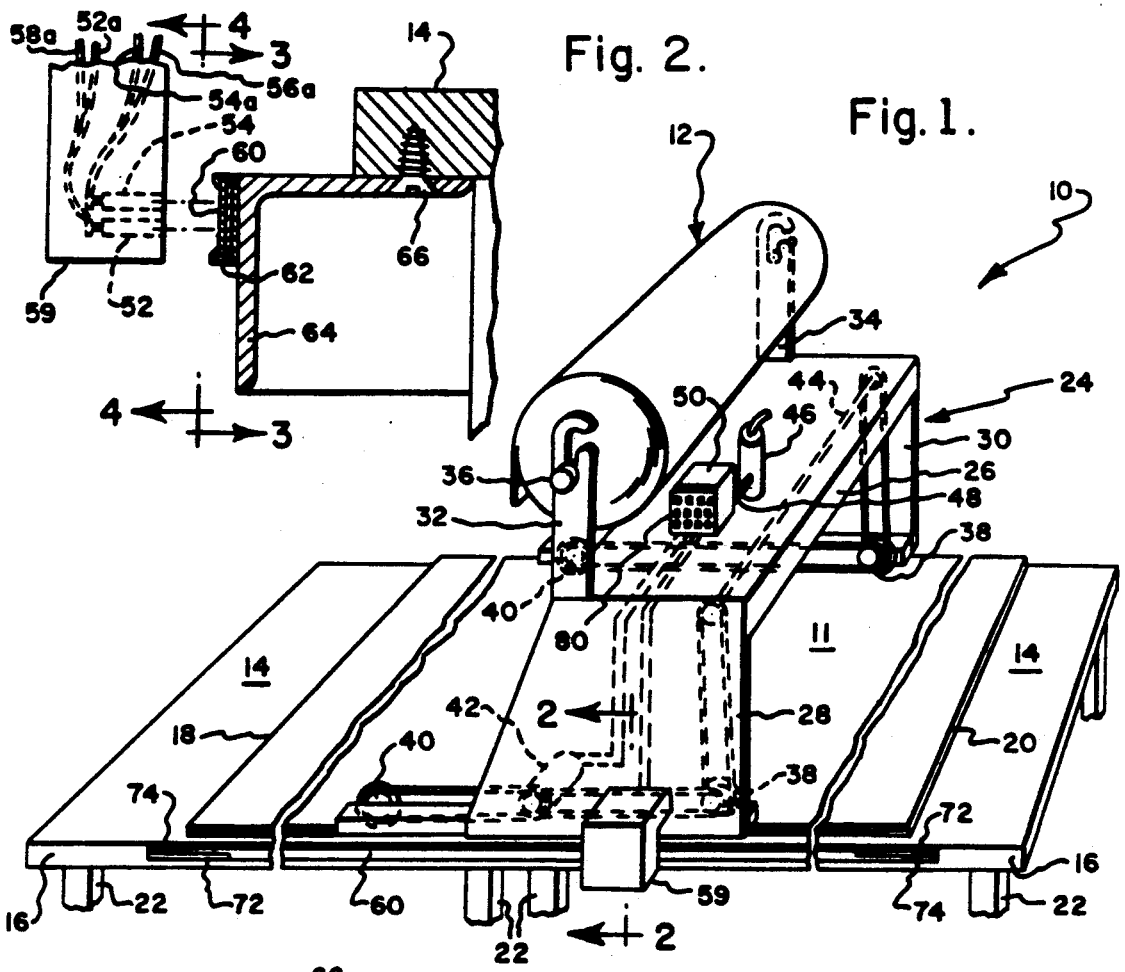
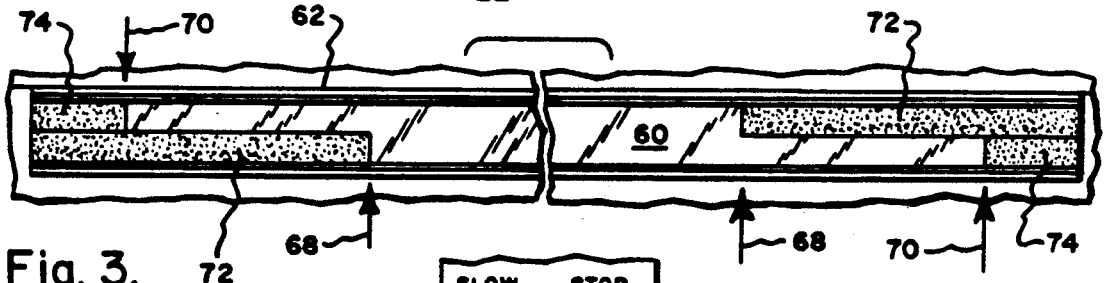
Fig. 3.
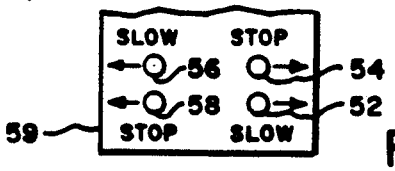
Fig. 4.
Fig. 5.
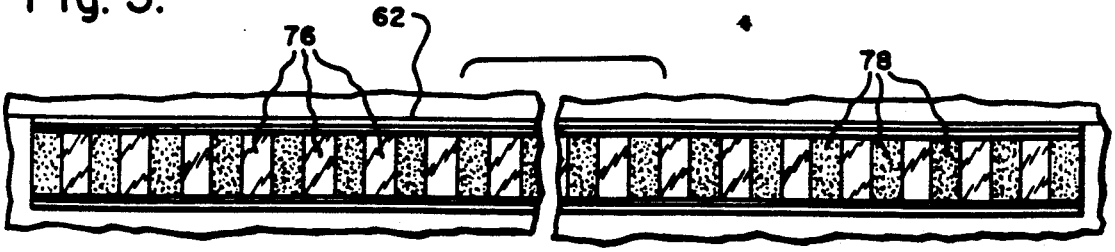

CLOTH-SPREADING APPARATUS HAVING IMPROVED CONTROL MEANS

TECHNICAL FIELD

The present invention relates to a cloth-spreading apparatus and more particularly to a novel cloth-spreading apparatus having improved control means carried in part by a movable carriage assembly, the control means being capable of slowing down and stopping the movement of the movable carriage at desired positions.

BACKGROUND OF THE INVENTION

Prior art cloth-spreading machines are well known in the art and one typical example is shown in U.S. Pat. No. 4,728,089 issued Mar. 1, 1988. Machines of the type shown in the above patent, as well as other machines, have been provided with switching means for slowing down a movable carriage assembly as it moves towards a first stop position and to subsequently stop or reverse the direction of movement of the carriage assembly as it attains the desired stop position. These mechanism have typically included trip mechanisms mounted upon the table assembly which supports, at least in part, the carriage assembly, and switch mechanisms which engage the trip mechanisms to initially slow down and subsequently to stop or reverse the direction of movement of the carriage assembly. Thus, in a typical installation, the carriage is provided with four mechanical switch mechanisms and the elongated table upon which the carriage assembly traverses is provided with right- and left-hand stop-trip mechanisms as well as right- and left-hand slowdown-trip mechanisms spaced inwardly of the stop-trip mechanisms. Typically, the above-described mechanisms will work in a satisfactory manner, but there are some inherent design disadvantages. Thus, if one of the stop-trip mechanisms should be removed, the carriage assembly will continue to operate in the initial direction long past the desired stop position as the associated switch will not be turned on. In addition, because mechanical switch mechanisms are employed, there is a tendency for these parts to wear out. Other disadvantages of this design are well known.

In the foregoing design, the trip mechanisms are typically iron rods or rails which are carried along the side of the table, which rails are suitably positioned to be engaged by the switch mechanisms. In order to avoid mechanical contact between the switch mechanisms and the trip mechanisms it has been proposed to utilize inductive-proximity switches, as for example in the Kuris spreading machine. This system still has the disadvantage in that if the switch means malfunctions, that is if it remains in the off position, the machine will not be slowed down or stopped when the appropriate rail has been reached. In addition, if the stop rail is missing, the carriage assembly will overshoot its stop position.

OBJECTS AND SUMMARY OF THE PRESENT INVENTION

It is an object of the present invention to provide a cloth-spreading apparatus having improved slowdown and stop control means which overcome the disadvantages of the prior art.

More specifically, it is an object of the present invention to provide control means which utilizes a sensing system which includes one or more photocells carried by a movable carriage assembly and a light-reflective medium carried by the table upon assembly which the carriage assembly moves, movement of the carriage being permitted when the light-reflective medium is sensed, and no movement being permitted in its absence.

It is a further object of the present invention to provide sensing means for a movable carriage including means which are in an "on" state when the carriage is moving an in an "off" state when the carriage is stopped.

In one embodiment of the above invention, upper and lower photocells are provided. The reflective material terminates at the stop position, a portion of the reflective material being covered up or cut away for a distance away from the stop position equal to the slowdown position. One of the photocells senses the slowdown position, and the other photocell senses the stop position. The photocells are in their "on" position when opposite a reflective strip. A controller processes the signals received from the photocells and causes a drive motor to slow down the movable carriage when the slowdown position is reached and to stop the carriage or reverse its direction when the stop position is attained. In an alterative embodiment the light-reflective medium may be provided with a plurality of nonreflective equally spaced apart bars and the control means can additionally be provided with digital means capable of counting the bars to determine slowdown and stop positions, the digital means controlling the motor and also being programmed to establish the slowdown and stop positions.

The above invention, as well as additional objects and advantages of the invention, will be more apparent after a consideration of the following detailed description taken in conjunction with the accompanying drawings in which preferred embodiments of this invention are illustrated.

BRIEF DESCRIPTION OF THE DRAWINGS

FIG. 1 is a perspective view of a cloth-spreading machine which is provided with one embodiments of this invention.

FIG. 2 is an enlarged sectional view taken generally along the line 2—2 in FIG. 1.

FIG. 3 is a view taken generally along the line 3—3 in FIG. 2, portions being omitted for clarity.

FIG. 4 is a view taken generally along the line 4—4 in FIG. 2.

FIG. 5 is a view similar to FIG. 3 but illustrating an alternative embodiment of a light-reflective strip assembly.

DETAILED DESCRIPTION

In the following detailed description, front and rear references, as well as right and left references, will refer to the view shown in FIG. 1. These references are for convenience only and should not be considered to be limiting. With reference now to the first embodiment of this invention, and more specifically with reference to FIG. 1, the cloth-spreading apparatus of this invention is indicated generally at 10. The cloth-spreading apparatus is capable of spreading a plurality of superimposed layers of cloth 11 from a roll of cloth, indicated generally at 12, onto a transversely extending work surface 14. The work surface 14 is the top surface of the table tops 16 of a plurality of end-to-end tables, and in operation the cloth-spreading apparatus is moved from a first location indicated by the left-hand edge 18 of the plurality of superimposed layers of cloth 11 to a second location indicated by the right-hand edge 20 of the superimposed layers of cloth 11. Typically, the tables are provided with a plurality of legs 22 adjacent tables being placed side-by-side and secured to each other to form an elongated table assembly, table which may be 20 to 30 meters long or longer. A moveable carriage assembly, indicated generally at 24, is supported upon the work surface of the elongated table assembly. The movable carriage assembly includes an upper frame assembly 26 and front and rear frame assemblies 28, 30, respectively. The roll of cloth 12 is supported upon the upper frame assembly and to this end a pair of front and rear arms 32, 34 are carried by the upper frame assembly. The end of a mandrel 36 being engaged by the front and rear arms, the mandrel passing through and supporting the roll of cloth 12 on the arms 32, 34. Each of the front and rear frame assemblies rotatably supports right and left wheels 38, 40, respectively, which wheels are adapted to engage the upper surface 14 of the elongated table assembly. Drive means in the form of an electric motor 42 is suitably carried by the carriage assembly 24 and drives the wheels in any conventional manner such as by timing belts or chains and suitable sheaves or sprockets. It should be noted that the wheels on both sides of the carriage assembly are driven and to this end a cross-drive shaft 44 is provided, which cross-drive shaft is driven from the motor 42, and causes the wheels on the other side of the carriage assembly to also be driven at the same speed. The motor is a reversible, two-speed electric motor. Typically, the movable carriage assembly is provided with an upwardly extending cable assembly 46 which carries suitable lead wires for connection to an overhead electric power line. The cable assemble is in turn connected by suitable leads 48 through a controller 50. The controller 50 is a part of control means which also includes sensing means.

In the first embodiment, illustrated in FIGS. 1 through 4, the sensing means includes four photoelectric eyes 52, 54, 56, and 58 which are carried by a photoelectric eye housing assembly 59 which, as can best be seen from FIG. 1, is carried by the front frame assembly 28 of the movable carriage assembly, a lower portion of the photoelectric housing assembly 59 extending below the upper surface 14 and to one side of the elongated table assembly. Each of the photoelectric cells 52 through 58 are connected to the controller by suitable pairs of leads **52*a* through 58*a* (FIG. 2), respectively. The sensing means further includes a light-reflective medium 60 which is carried by a plastic extrusion 62 having the cross-sectional shape indicated in FIG. 2. The extrusion 62 is in turn mounted on an L-shaped bracket 64 which is screwed by screws 66 or otherwise suitable secured to the bottom edge of the table top. As can best be seen from FIG. 2 the electric eyes 52 through 58 are in register with the reflective medium 60**.

The reflective medium will extend the full length from the first position 18 to the second position 20 and will terminate or be entirely covered up at each of these positions. The light-reflective medium 60 will normally have a top-to-bottom dimension of approximately 1 inch except in those areas where it is desired for the carriage to slow down. Accordingly, in the area between the beginning of the slowdown position indicated by arrow 68 in FIG. 3, and the stop position indicated by arrow 70 in FIG. 3, a portion of the reflective material will be either covered up by a nonreflective material 72, or be cut away to expose a nonreflective material. Similarly, the very end of the reflective strip may be cut away at the stop position 70 to expose an nonreflective surface, or otherwise be covered up by a nonreflective surface 74.

In operation, the carriage assembly 24 is typically driven by the drive means 38, 40, 42 at full speed until a slowdown position is reached. Specifically, if the carriage assembly 24 is being driven towards the left-hand stop position 18 from the position shown in FIG. 1 both electric eyes 52, 54 will sense the reflective strip 60 until the nonreflective portion 72 is sensed at the slowdown position by electric eye 52. This will cause the controller 50 to slowdown the motor 42. When the electric eye 54 senses the end of reflective strip 60 at stop position 70, this will cause the controller 50 to either stop the electric motor 42 or to cause it to reverse directions according to the manner in which the controller 50 is programmed. If the direction is caused to be reversed, the carriage assembly will now move to the right-hand position 20 until the electric eye 56 senses the nonreflective portion 72 on the right-hand side which will then cause the controller to slow the motor 42. When position 70 is attained and the electric eye 58 senses the additional nonreflective portion 74, the electric motor will be caused to be stopped or reversed.

In the embodiment of FIGS. 1 through 4, each of the electric eyes will be in an "on" or closed state when in register with the reflective strip 60, and in an "off" or "open" state when not in register.

It should be appreciated from the above that should one of the electric eyes become inoperative as it will be sending an "off" or "open" state signal to the controller it would cause the machine to slowdown or stop. Similarly, if the reflective tape should be knocked off the edge of the machine, it will also cause the controller to stop the movement of the carriage assembly as an "off" signal is being received from either the stop cell 54 or the stop cell 58. This would also happen if the reflective tape were covered with cloth. By positioning the reflective material in a vertical plane as illustrated in FIG. 2, dust will not collect on it to any appreciable extent. It is also possible to easily change the first and second positions by adding more reflective material or covering up portions of the reflective material. While four electric eyes are shown in FIG. 4, it should be appreciated that two electric eyes or even one may be employed. If two electric eyes were employed, one being positioned above the other as indicated in FIG. 4, each would be responsible for sensing slowdown or stop positions in either direction. If a single eye were employed, it could sense diminished reflection or alternatively, the controller could be programmed to slowdown the electric motor when a nonreflective surface 72 or 74 is encountered by the electric eye and to stop or reverse movement after a predetermined travel distance. While these various alternative designs may be utilized, it is believed, at least at the present time, that the embodiment shown in FIG. 4 will be most satisfactory.

In the embodiment shown in FIG. 5, a light-reflective medium 76 is provided with a plurality of nonreflective, equally spaced apart bars 78. The photoelectric eye housing 59 need only carry two photoelectric eyes, which eyes are laterally spaced apart preferably one quarter of the distance of the strip pattern. During movement of the carriage assembly 24 from a first position to a second position the eyes will sense the number of bars 78 and the direction of movement. This signal is then processed by the controller until a suitable number of bars have been counted at which point the controller will cause the drive motor to be slowed down and eventually to be stopped after additional bars have been counted. With this form of apparatus, it is necessary to provide digital means within the controller which are capable of counting bar signals to determine slowdown and stop periods, which digital means is programmed, preferably through keypad similar to the keypad 80 on the controller 50, so that the desired slowdown and stop positions are stored in the controller.

While preferred embodiments in which the principles of the present invention have been incorporated are shown and described above, it is to be understood that this invention is not to be limited to the particular details shown and described above, but that, in fact, widely differing means may be employed in the practice of the broader aspects of this invention.

What is claimed is:

1. A cloth-spreading apparatus having an elongated worktable assembly, a movable carriage assembly at least partially supported on the worktable assembly, the carriage assembly carrying a roll of cloth which is to be spread upon the worktable as the carriage assembly moves between the first and second spaced-apart locations on the worktable assembly, drive means for driving the movable carriage assembly in either direction, and control means for controling the drive means as the carriage assembly is being driven towards either of the first or second spaced-apart locations, the control means causing the drive means to be shifted from a high speed to a slow speed as the carriage assembly approaches the first or second location, and further causing the carriage assembly to stop or reverse direction when it attains the first or second position, the control means including sensing means to sense the slow-down and stop positions; characterized in that the sensing means includes photocell means carried by the carriage and a light-reflective medium supported by the worktable, wherein the light-reflective medium is provided with equally spaced-apart nonreflective bars, and wherein the control means is provided with digital means capable of counting the bars to determine slowdown and stop positions.

2. The cloth-spreading apparatus as set forth in claim 1 wherein the two additional photocells are provided, these photocells being capable of sensing the slowdown and stop position as the carriage assembly moves in the opposite direction.

3. The cloth-spreading apparatus as set forth in claim 1 wherein the digital means is programmable so that the slowdown and stop positions may be varied.

4. A cloth-spreading apparatus having an elongated worktable assembly, a movable carriage assembly at least partially supported on the worktable assembly, the carriage assembly carrying a roll of cloth which cloth is to be spread upon the worktable as the carriage assembly moves between the first and second spaced-apart locations on the worktable assembly, drive means for driving the movable carriage assembly in either direction, and control means for controling the drive means as the carriage assembly is being driven towards either of the first or second spaced-apart locations, the control means causing the drive means to be shifted from a high speed to a slow speed as the carriage assembly approaches the first or second location, and further causing the carriage assembly to stop or reverse direction when it attains the first or second position, the control means including sensing means to sense the slow-down and stop positions; characterized in that the sensing means includes photocell means carried by the carriage and a light-reflective medium supported by the worktable, and wherein the sensing means is in an "on" state when the carriage is moving and an "off" state when the carriage is stopped.

5. The cloth-spreading apparatus as set forth in claim 4 wherein the sensing means includes two sensors for controlling the movement of the carriage, both of which are in an "on" state when the carriage is moving at full speed, one of which is in an "on" state and the other of which is in an "off" state when the carriage is moving at a slowdown speed, and both of which are in an "off" state when the carriage is stopped.

6. A cloth-spreading apparatus having an elongated worktable assembly, a movable carriage assembly at least partially supported on the worktable assembly, the carriage assembly carrying a roll of cloth which cloth is to be spread upon the worktable as the carriage assembly moves between the first and second spaced-apart locations on the worktable assembly, drive means for driving the movable carriage assembly in either direction, and control means for controling the drive means as the carriage assembly is being driven towards either of the first or second spaced-apart locations, the control means causing the drive means to be shifted from a high speed to a slow speed as the carriage assembly approaches the first or second location, the carriage assembly approaches the first or second location, and further causing the carriage assembly to stop or reverse direction when it attains the first or second position, the control means including sensing means to sense the slow-down and stop positions; characterized in that sensing means includes photocell means carried by the carriage and a light-reflective medium supported by the worktable, wherein first portions of the light-reflective medium terminate at either stop position, wherein second portions of the light-reflective medium terminate at either slow-down position, and wherein two photocells are provided, one for sensing the slow-down position, and the other for sensing the stop-position as the carriage is moved towards the first or second locations.

* * * * *